US008235122B2

(12) United States Patent
Gette

(10) Patent No.: US 8,235,122 B2
(45) Date of Patent: Aug. 7, 2012

(54) COMBINATION WELL PIPE CENTRALIZER AND OVERPULL INDICATOR

(75) Inventor: Nicholas P. Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 275 days.

(21) Appl. No.: 12/620,373

(22) Filed: Nov. 17, 2009

(65) Prior Publication Data

US 2011/0114330 A1 May 19, 2011

(51) Int. Cl.
*E21B 23/00* (2006.01)

(52) U.S. Cl. ..... 166/348; 166/341; 166/368; 166/378; 166/242.6; 285/123.3

(58) Field of Classification Search ..... 166/348, 166/341, 378, 382, 89.3, 88.2, 88.3, 242.6, 166/242.7, 338, 339; 285/123.1, 123.3–123.5
See application file for complete search history.

(56) References Cited

U.S. PATENT DOCUMENTS

| | | | | | |
|---|---|---|---|---|---|
| 3,472,530 | A | * | 10/1969 | Fowler | 285/3 |
| 3,893,717 | A | * | 7/1975 | Nelson | 285/3 |
| 4,051,896 | A | * | 10/1977 | Amancharla et al. | 166/123 |
| 4,520,869 | A | | 6/1985 | Svenson | |
| 4,528,738 | A | * | 7/1985 | Galle, Jr. | 29/416 |
| 4,751,968 | A | * | 6/1988 | Ames et al. | 166/368 |
| 4,875,524 | A | | 10/1989 | Bradley et al. | |
| 4,909,546 | A | * | 3/1990 | Nobileau | 285/123.4 |
| 4,979,566 | A | * | 12/1990 | Hosie et al. | 166/285 |
| 5,044,438 | A | | 9/1991 | Young | |
| 5,238,062 | A | | 8/1993 | Reinholdt | |
| 5,421,407 | A | * | 6/1995 | Thornburrow | 166/85.3 |
| 5,575,333 | A | | 11/1996 | Lirette et al. | |
| 5,908,072 | A | | 6/1999 | Hawkins | |
| 6,257,339 | B1 | | 7/2001 | Haugen et al. | |
| 6,435,275 | B1 | | 8/2002 | Kirk et al. | |
| 6,453,998 | B1 | | 9/2002 | Reeve | |
| 6,453,999 | B1 | | 9/2002 | Reinholdt | |
| 6,457,519 | B1 | | 10/2002 | Buytaert | |
| 6,585,052 | B2 | | 7/2003 | Angman et al. | |
| 6,637,511 | B2 | | 10/2003 | Linaker | |

(Continued)

FOREIGN PATENT DOCUMENTS

EP 0509157 A1 10/1992

OTHER PUBLICATIONS

GB1019090.8, Intellectual Property Office UK and Written Opinion, Jan. 28, 2011.

(Continued)

*Primary Examiner* — Thomas Beach
*Assistant Examiner* — Matthew Buck
(74) *Attorney, Agent, or Firm* — Bracewell & Giuliani LLP

(57) ABSTRACT

A subsea wellhead assembly includes an outer wellhead member with a bore containing at least one conical generally upward facing load shoulder that inclines relative to an axis of the bore. The outer wellhead member also contains an overpull recess having a generally downward facing overpull shoulder positioned below the at least one generally upward facing load shoulder. An inner wellhead member is lowered into the housing, the inner wellhead member having at least one conical downward facing load shoulder that inclines relative to an axis of the bore. A load ring has an inner profile that slidingly engages the downward facing load shoulder and an outer profile that slidingly engages the upward facing load shoulder.

20 Claims, 3 Drawing Sheets

U.S. PATENT DOCUMENTS

| | | | | |
|---|---|---|---|---|
| 6,679,325 | B2 | 1/2004 | Buytaert | |
| 6,695,059 | B2 * | 2/2004 | Thomas et al. | 166/368 |
| 6,725,939 | B2 | 4/2004 | Richard | |
| 6,871,706 | B2 | 3/2005 | Hennessey | |
| 7,040,407 | B2 | 5/2006 | Jennings et al. | |
| 7,071,697 | B2 | 7/2006 | Rioufol et al. | |
| 7,150,323 | B2 | 12/2006 | Ford | |
| 7,219,738 | B2 | 5/2007 | Reimert | |
| 7,234,528 | B2 * | 6/2007 | Pallini et al. | 166/343 |
| 7,380,607 | B2 | 6/2008 | Thomas | |
| 7,743,832 | B2 * | 6/2010 | Shaw et al. | 166/338 |
| 7,886,835 | B2 * | 2/2011 | Arumugam et al. | 166/386 |
| 8,066,064 | B2 * | 11/2011 | Minassian et al. | 166/89.3 |
| 2010/0007089 | A1 * | 1/2010 | Adamek | 277/322 |

OTHER PUBLICATIONS

U.S. Appl. No. 12/415,198, filed Mar. 31, 2009 "Wellhead System Having Resilient Device to Actuate a Load Member and Enable an Over-Pull Test of the Load Member".

* cited by examiner

COMBINATION WELL PIPE CENTRALIZER AND OVERPULL INDICATOR

FIELD OF THE INVENTION

This technique relates in general to centralizers for centering well pipe strings in wellbores, and, in particular, a well pipe hanger centralizer and overpull indicator.

BACKGROUND OF THE INVENTION

Centralizers have been in use for a long time. As their name suggests they have been used to center a tubular in a borehole. Centralizers are used on well pipe hangers to centralize the hanger, allowing the hanger to land on the corresponding tag shoulder properly, thereby preventing premature actuation of setting resistance devices, such as hanger load rings. The centralizers prevent the casing from side loading the hanger against the wellhead, which could result in premature actuation of setting resistance devices. The centralizers have been made of metal and non-metallic materials such as thermoplastic polyamides, glass, and mineral filled nylons and polytetra fluoro ethylene, also known as Teflon and injection molded polyurethane. These centralizers were made in hinged segments that could be clamped onto a tubular and in some applications the centralizers were formed right on to or slipped over the rod or tubular. Many centralizers use slotted bodies which may potentially scratch sealing bores.

A need exists for a technique that ensures that a well pipe hanger is properly centralized and set. The following technique may solve one or more of these problems.

SUMMARY OF THE INVENTION

In an embodiment of the present technique, an outer wellhead member has a bore containing at least one conical generally upward facing load shoulder that inclines relative to an axis of the bore. The outer wellhead member also contains an overpull recess having a generally downward facing overpull shoulder positioned below the at least one generally upward facing load shoulder. An inner wellhead member is landed in the outer wellhead member. The inner wellhead member has at least one conical downward facing load shoulder that inclines relative to an axis of the bore. A load ring is carried by the inner wellhead member for supporting the inner wellhead member on the upward facing load shoulder. The load ring has an inner profile that slidingly engages the downward facing load shoulder of the inner wellhead member and an outer profile that slidingly engages the upward facing load shoulder of the outer wellhead member. The load ring is carried by the inner wellhead member for movement between a retracted position, wherein the outer profile is spaced radially inward from the upward facing load shoulder, and an expanded position wherein the outer profile is in engagement with the upward facing load shoulder.

A centralizer/overpull assembly is carried by the inner wellhead member, below the load ring, for centralizing the inner wellhead member as it is lowered into the outer wellhead member, thereby preventing the load ring from prematurely setting. The centralizer/overpull assembly comprises a spring element and a centralizer/overpull ring positioned within a recess on the outer surface of the inner wellhead member. The centralizer/overpull ring has a generally upward facing overpull shoulder that is geometrically complimentary to the generally downward facing overpull shoulder of the outer wellhead member. The centralizer/overpull assembly is carried by the inner wellhead member for movement between a retracted position and an expanded position. When the inner wellhead member is in the landing position, the centralizer/overpull assembly is forced inward into the retracted position within the recess in the inner wellhead member. When the inner wellhead has been properly set and the load ring fully engaged, the centralizer/overpull assembly springs radially outward into the overpull recess in the outer wellhead member. In order to determine if the inner wellhead member and load ring are in the proper position, an overpull is made on the well string connected to the inner wellhead member. The generally downward facing overpull shoulder of the recess in the outer wellhead member abuttingly contacts the generally upward facing overpull shoulder of the centralizer/overpull ring, preventing upward movement of the inner wellhead member and indicating that the inner wellhead member and load ring are in the proper position.

DETAILED DESCRIPTION OF THE INVENTION

Figure 1:
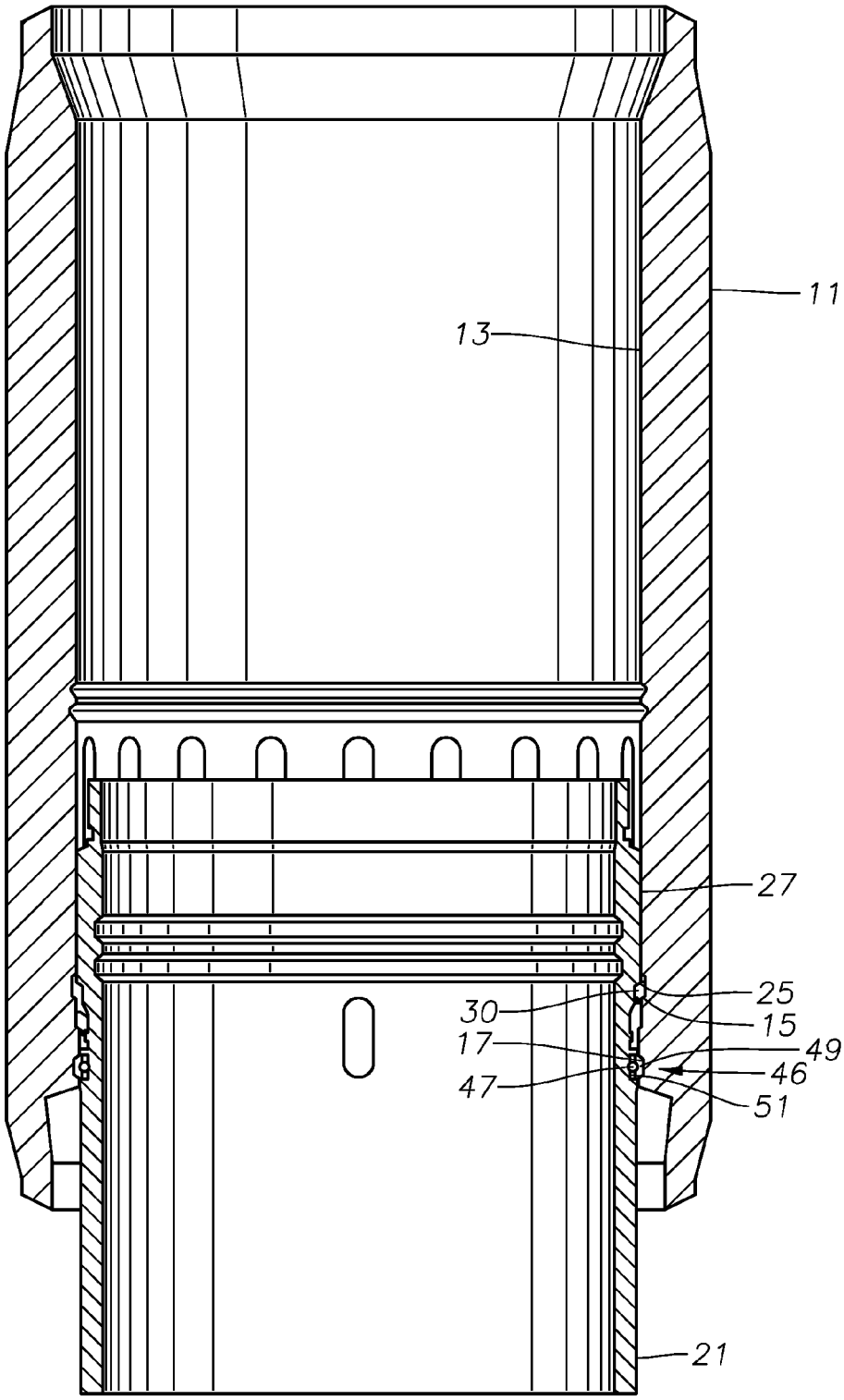
FIG. 1 is a vertical sectional view of an inner wellhead member, load ring, and centralizer/overpull assembly shown in the set position within an outer wellhead member and constructed in accordance with this invention.

Referring to FIG. 1, an embodiment of an outer wellhead member 11 is illustrated. In this embodiment, outer wellhead member 11 is a landing sub connected to well pipe positioned below a high pressure wellhead housing. However, outer wellhead member 11 may be a high pressure housing or other housing having an axial bore 13.

Figure 5:
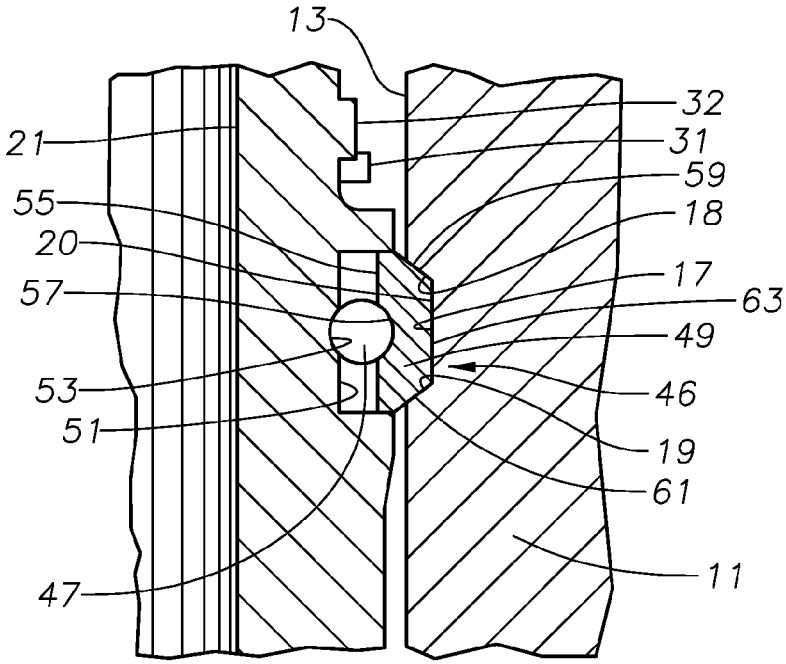
FIG. 5 is an enlarged view of a portion of the inner wellhead member and the centralizer/overpull assembly shown in the set position within the outer wellhead member of FIG. 1.

As best illustrated in FIG. 1, bore 13 has a tag/load shoulder 15 located within it. Tag/load shoulder 15 is a circular ledge located at a junction between a larger diameter upper portion in bore 13 and a slightly smaller diameter lower portion of bore 13 to define one embodiment of a profile portion of bore 13. As best illustrated in FIG. 5, bore 13 also has an annular overpull recess 17 located within it, a select distance below tag/load shoulder 15. Overpull recess 17 is formed by a generally downward facing overpull shoulder 18 and a generally upward facing shoulder 19, with a surface 20 that is generally cylindrical and concentric to the axis of outer wellhead member 11 extending therebetween.

Referring again to FIG. 1, an inner wellhead member 21 lands within outer wellhead member 11 in the illustrated embodiment. For example, inner wellhead member 21 may be a well pipe hanger, such as a casing hanger. Inner wellhead member 21 has a profile made up of a load shoulder 25, which may be geometrically complimentary to tag/load shoulder 15 of outer wellhead member 11. In this embodiment, there is one inner wellhead member load shoulder 25 and one outer wellhead member tag/load shoulder 15. The number of load shoulders 15, 25 can vary. An enlarged portion 27 of inner wellhead member 21 directly above load shoulder 25 has a diameter only slightly less than the inner diameter of bore 13.

Figure 3:
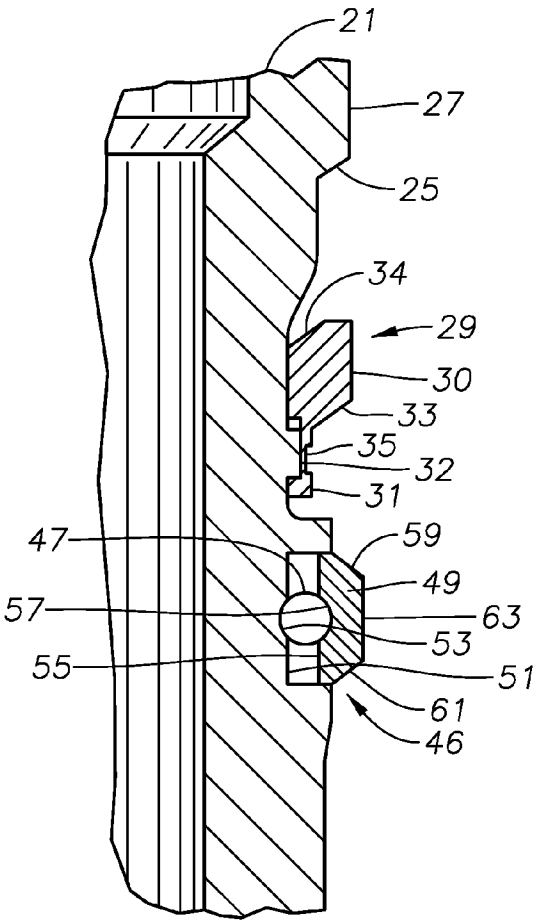
FIG. 3 is an enlarged view of a portion of the inner wellhead member of FIG. 2.
Figure 2:
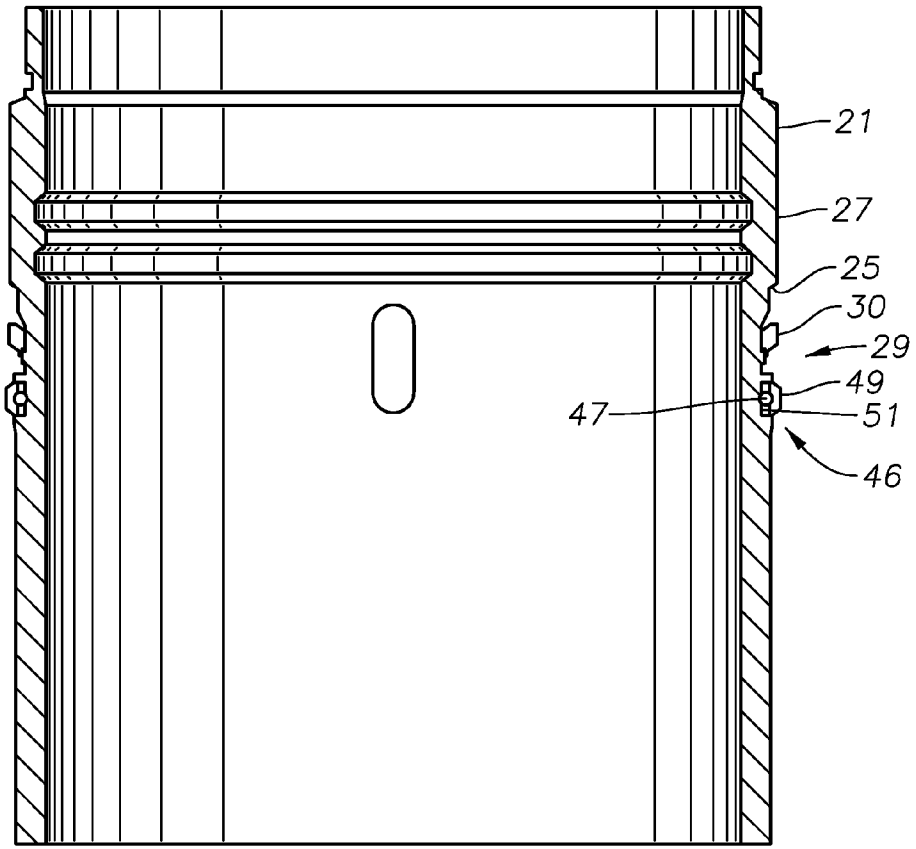
FIG. 2 is an isolated sectional view of the inner wellhead member of FIG. 1, shown prior to setting.

Referring to FIGS. 2 and 3, in the illustrated embodiment, a split load ring 29 is mounted on inner wellhead member 21 to support inner wellhead member 21 on outer wellhead member tag/load shoulder 15 (FIG. 1). In this particular embodiment, load ring 29 is a ring having an upper portion 30 and a lower portion 31 connected to one another by a thin band portion 35 that acts as a designed failure point. Ring 29 is positioned on a flange 32 that extends radially outward from inner wellhead member 21. However, load ring 29 is not limited to this particular embodiment. Load ring 29 has an external load shoulder 33 for mating with outer wellhead member tag/load shoulder 15 (FIG. 1). Load ring 29 has an internal shoulder 34 for mating with inner wellhead member load shoulder 25. Internal load shoulder 34 faces upward and inward at the same angle as inner wellhead member load shoulder 25. Load ring external shoulder 33 faces downward and outward at the same angle as outer wellhead member tag/load shoulder 15 (FIG. 1). External load shoulder 33 of load ring 29 is dimensioned to land on tag/load shoulder 15 in outer wellhead member bore 13 (FIG. 1).

Referring still to FIG. 3, a centralizer/overpull assembly 46 is mounted to the inner wellhead member 21, below load ring 29. Centralizer/overpull assembly 46 comprises a spring element 47 and a split centralizer/overpull ring 49 positioned within an annular recess 51 on the outer surface of inner wellhead member 21. In this particular embodiment, spring element 47 comprises an elastomeric ring. The size and stiffness of spring element 47 can be varied depending upon the desired centralizing force. In this particular embodiment, recess 51 contains a detent 53 that is geometrically complimentary to elastomeric ring 47. In this particular embodiment, centralizer/overpull ring 49 has an inner surface 55 with a detent 57 that is geometrically complimentary to elastomeric ring 47. The outer surface of centralizer/overpull ring 49 comprises a generally upward facing shoulder 59, geometrically complimentary to generally downward facing overpull shoulder 18 of outer wellhead member 11 (FIG. 5). The outer surface of centralizer/overpull ring 49 also comprises a generally downward facing shoulder 61, geometrically complimentary to generally upward facing shoulder 19 of outer wellhead member 11 (FIG. 5). Surface 63 is generally cylindrical and concentric to the axis of inner wellhead member 21 and extends between generally upward facing shoulder 59 and generally downward facing shoulder 61. Surface 63 is geometrically complimentary to surface 20 of outer wellhead member 11 (FIG. 5). Elastomeric ring 47 rides in recess 51, between the outer surface of inner wellhead member 21 and centralizer/overpull ring 49.

Figure 4:
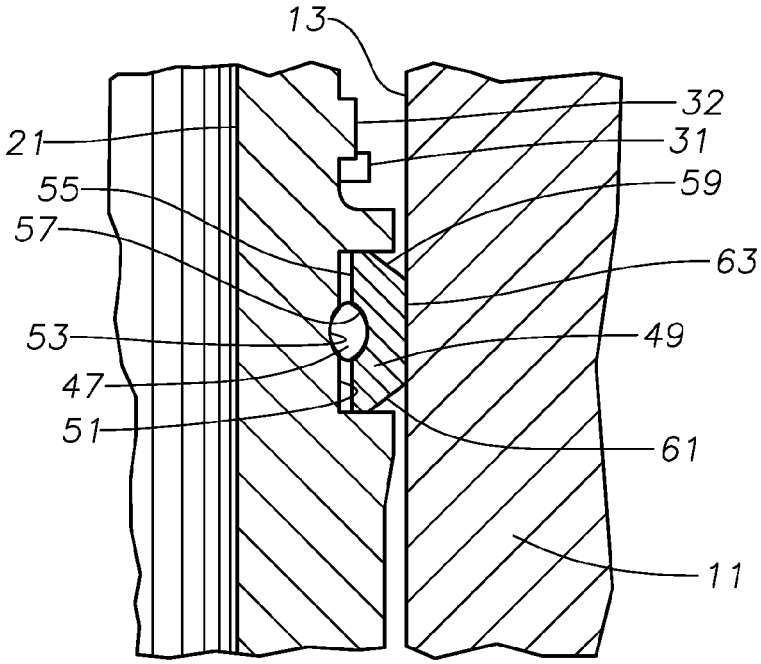
FIG. 4 is an enlarged view of a portion of the inner wellhead member and the centralizer/overpull assembly shown in the landing position within the outer wellhead member.

In the initial orientation of inner wellhead member 21 of FIGS. 2 and 3, prior to tripping inner wellhead member 21 into outer wellhead member 11, centralizer/overpull ring 49 is fully expanded, with the outer diameter of centralizer/overpull ring 49 being greater than or equal to the outer diameter of load ring 29. In the trip-in position of FIG. 4, as inner wellhead member 21 is tripped into the well, centralizer/overpull ring 49 is compressed into recess 51 by outer wellhead member 11 as centralizer/overpull ring 49 centralizes inner wellhead member 21 in outer wellhead member 11. In the landed position of FIGS. 1 and 5, centralizer/overpull ring 49 is expanded radially outward into the overpull recess 17 in the surface of bore 13 of outer wellhead member 11.

In the trip-in operation of inner wellhead member 21, load ring 29 will be in the retracted position shown in FIGS. 2 and 3. The outer diameter of load ring 29 in this position is no greater than the outer diameter of inner wellhead member 21 at enlarged diameter portion 27. Prior to entering bore 13 of outer wellhead member 21, centralizer/overpull assembly 46 is expanded, with the outer diameter of centralizer/overpull ring 49 being greater than or equal to the outer diameter of load ring 29. As inner wellhead member 21 is lowered into bore 13, centralizer/overpull ring 49 and spring element 47 are compressed by bore 13 to centralize inner wellhead member 21 in outer wellhead member 11 and prevent premature side loading of load ring 29. As inner wellhead member 21 is further lowered into bore 13, centralizer/overpull ring 49 lands on outer wellhead member tag/load shoulder 15. The generally downward facing shoulder 61 of centralizer/overpull ring 49 will contact tag/load shoulder 15, pushing ring 49 radially inward into recess 51, further compressing spring element 47, allowing centralizer/overpull ring 49 to move below tag/load shoulder 15.

As inner wellhead member 21 further enters bore 13, load ring 29, and in particular, external load shoulder 33 (FIG. 3) will land on outer wellhead member tag/load shoulder 15. As inner wellhead member 21 continues to move downward in the landing position, the force on load ring 29, causes the upper portion 30 of load ring 29 to separate from the lower portion 31 of ring 29 at the designed failure point, which can be thin band 35, effectively pushing and moving the upper portion 30 of load ring 29 radially outward just above tag/load shoulder 15. Therefore, load ring 29 can include a shearable lock mechanism, thin band 35, that holds upper portion 30 in a run-in position until landing on upward facing tag/load shoulder 15.

Referring to FIGS. 1 and 5, from this point, inner wellhead member 21 moves downward relative to load ring 29, until load ring 29 is fully engaged with shoulders 15 of outer wellhead member 11 and shoulder 25 of inner wellhead member 21 and inner wellhead member 21 is in a set position within outer wellhead member 11. In addition, as inner wellhead member 21 moves downward relative to load ring 29, centralizer/overpull assembly 46 moves downward with inner wellhead member 21 until centralizer/overpull assembly 46 reaches overpull recess 17 (FIG. 5). When inner wellhead member 21 reaches the set position, centralizer/overpull assembly 46 simultaneously reaches recess 17, spring element 47 expands, pushing centralizer/overpull ring 49 radially outward and into overpull recess 17, and moving centralizer/overpull assembly 46 to an expanded position.

Once fully engaged, generally downward facing load shoulder 25 of inner wellhead member 21 is in contact with internal load shoulder 34 of load ring 29, and tag/load shoulder 15 of outer wellhead member 21 is in contact with external load shoulder 34 of load ring 29. Downward load on inner wellhead member 21 transfers from inner wellhead member 21 load shoulder 25 through load ring 29 to outer wellhead member tag/load shoulder 15.

A reduction in the indication of the weight of the running string is an indication that load ring 29 has set. As a further assurance, the operator can apply a selected overpull. An overpull is a test where a lifting force is applied by the running string to inner wellhead member 21. Referring to FIGS. 1 and 5, when in the set position, centralizer/overpull ring 49 rests within recess 17 on the outer wellhead member 21. As previously discussed, the outer surfaces of centralizer/overpull ring 49 are geometrically complimentary to the surfaces of recess 17. As a result, generally upward facing overpull shoulder 59 of centralizer/overpull ring 49 abuts against generally downward facing overpull shoulder 18 of recess 17. For a given centralizer/overpull assembly 46, a defined overpull, for example, 200,000 pounds, is necessary to cause centralizer/overpull ring 49 to move radially inward into recess 51 on inner wellhead member 21, thereby moving centralizer/overpull assembly 46 to a retracted position. Therefore, the operator will pull upward a fraction of that amount, for example, 100,000 pounds, to determine if generally upward facing overpull shoulder 59 of centralizer/overpull ring 49 is abuttingly contacting generally downward facing overpull shoulder 18 of recess 17. If the pull upward does not result in the upward movement of the inner wellhead member 21, this indicates that centralizer/overpull assembly 46 is located correctly and, therefore, load ring 29 is located correctly and has properly set. The operator can then slack off the weight.

The technique has significant advantages. The centralizer/overpull ring maintains full circumferential contact with the inner surface of the outer wellhead member, preventing sealing bores from being scratched. The centralizing force of the centralizer/overpull assembly can be custom tailored by switching out different size and stiffness spring elements. Additionally, the centralizer/overpull assembly acts as a centralizer and also allows an overpull to be made to ensure that the load ring is properly set.

While the technique has been shown in only two of its forms, it should be apparent to those skilled in the art that it is not so limited but is susceptible to various changes without departing from the scope of the technique.

The invention claimed is:

1. A wellhead assembly comprising:

an outer wellhead member having a bore, the bore having a first profile portion and an annular recess;

a tubular inner wellhead member adapted to be lowered into the bore of the outer wellhead member;

a radially expandable load ring carried on the inner wellhead member for engagement with the first profile portion of the outer wellhead member, the expandable load ring being able to support the inner wellhead member in the axial direction when landed on the outer wellhead member; and a radially expandable and contractible centralizer/overpull ring positioned on the inner wellhead member and spaced apart from the radially expandable load ring, the centralizer/overpull ring being biased to expand outward to engage the bore of the outer wellhead member to center the inner wellhead member within the bore as the inner wellhead member is lowered through the bore, wherein the recess of the outer wellhead member is adapted to receive the centralizer/overpull ring and oppose axial movement of the centralizer/overpull ring to enable an upward test pull of the inner wellhead member.

2. The wellhead assembly of claim 1, wherein the wellhead assembly is adapted so that the load ring is expanded outward to engage the first profile portion of the outer wellhead member when the centralizer/overpull ring is received by the recess in the outer wellhead member.

3. The wellhead assembly of claim 2, wherein the load ring is radially expanded as the inner wellhead member is lowered through the bore relative to the outer wellhead member.

4. The wellhead assembly of claim 1, wherein the centralizer/overpull ring is fixed axially relative to the inner wellhead member.

5. The wellhead assembly of claim 1, wherein the centralizer/overpull ring is a split ring biased outwardly by a spring element.

6. The wellhead assembly of claim 1, further comprising a radially expandable and contractible spring element positioned within an annular recess of the inner wellhead member, the spring element having an inner surface portion thereof in contact with the inner wellhead member and an outer surface portion in contact with an inner surface portion of the centralizer/overpull ring.

7. The wellhead assembly of claim 1, wherein the first profile portion comprises an upward facing shoulder, and the centralizer/overpull ring is carried in a cavity on inner wellhead member and has an outer diameter greater than the inner diameter of the generally upward facing shoulder, but retracts inward into the cavity when moving past the generally upward facing shoulder.

8. The wellhead assembly of claim 1, further comprising:

a shearable lock mechanism that holds the load ring in a run-in position until landing on an upward facing load shoulder of the first profile portion.

9. A wellhead assembly comprising:

an outer wellhead member having a bore, the bore having a generally upward facing load shoulder and an annular recess forming at least one generally downward facing overpull shoulder formed therein, the annular recess being located apart from and below the generally upward facing load shoulder;

an inner wellhead member adapted to be lowered into the outer wellhead member and moveable, relative to the outer wellhead member, from a run-in position to a set position in response to axial force, the inner wellhead member having a generally downward facing load shoulder, the inner wellhead member also having an annular recess located in and extending circumferentially therearound;

a load ring carried on the inner wellhead member, the inner wellhead member being downwardly movable relative to the load ring between the run-in position and the set position after the load ring lands on the generally upward facing load shoulder of the outer wellhead member;

a radially expandable and contractible spring element positioned within the annular recess of the inner wellhead member, the spring element having an inner surface portion thereof in contact with the inner wellhead member and an outer surface portion; and a radially expandable and contractible centralizer/overpull ring positioned partially within the annular recess of the inner wellhead member, an inner surface portion thereof in contact with the outer surface portion of the spring element, the centralizer/overpull having an outer diameter greater than or equal to that of the load ring, the centralizer/overpull ring adapted to snap into engagement with the annular recess of the outer wellhead member as the inner wellhead member moves relative to the load ring from the run-in to the set position, the centralizer/overpull ring allowing an upward test pull once engaged with the annular recess of the outer wellhead member.

10. The wellhead assembly of claim 9, the centralizer/overpull ring further comprising:

a generally downward facing shoulder adapted to engage the at least one generally upward facing load shoulder when the inner wellhead member is being lowered into the outer wellhead member, thereby forcing the centralizer/overpull ring radially inward to a retracted position and into the recess on the inner wellhead member; and a generally upward facing overpull shoulder adapted to engage the generally downward facing overpull shoulder of the outer wellhead member when the continued downward movement of the inner wellhead member relative to the outer wellhead member causes the centralizer/overpull ring to move radially outward from the retracted position to an expanded position and into the recess on the outer wellhead member.

11. The wellhead assembly of claim 9, wherein the centralizer/overpull ring is a split ring biased outwardly by the spring element.

12. The wellhead assembly of claim 9, wherein the spring element is an elastomeric ring.

13. The wellhead assembly of claim 9, further comprising:

a shearable lock mechanism that holds the load ring in the run-in position until landing on the generally upward facing load shoulder.

14. The wellhead assembly of claim 9, wherein the centralizer/overpull ring is a split ring biased outwardly by the spring element; and wherein the spring element is an elastomeric ring.

15. A method of assembling a wellhead assembly, the method comprising:

(a) providing an outer wellhead member having a bore, the bore having a generally upward facing load shoulder, the bore also having an annular recess located therein and positioned below the generally upward facing load shoulder, and providing an inner wellhead member having a generally downward facing load shoulder, an axially movable load ring below the downward facing load shoulder and a centralizer/overpull assembly positioned below the load ring;

(b) lowering the inner wellhead member into the bore of the outer wellhead member and landing the load ring on the upward facing load shoulder; then (c) continuing lowering the inner wellhead member into the bore of the outer wellhead member further, thereby engaging the centralizer/overpull assembly with the recess and the downward facing load shoulder with the load ring; then (d) applying an upward test force to the inner wellhead member, which is resisted by the engagement of the centralizer/overpull assembly with the recess to ensure that the load ring is in a set position.

16. The method of claim 15, wherein step (a) further comprises:

biasing the centralizer/overpull assembly outwardly.

17. The method of claim 15, further comprising, after step (a), but before landing the load ring on the upward facing load shoulder:

engaging the centralizer/overpull assembly on the generally upward facing load shoulder, thereby causing the centralizer/overpull assembly to retract and move downward with the inner wellhead member.

18. The method of claim 15, wherein step (a) further comprises:

providing a lock member and securing the load ring in a run-in axial position with the lock member to prevent movement of the inner wellhead member relative to the load ring; and wherein step (b) further comprises:

shearing the lock member to allow the inner wellhead member to move further downward relative to the load ring.

19. The method of claim 15, wherein step (a) further comprises:

providing a lock member and securing the load ring in a run-in axial position with the lock member to prevent movement of the inner wellhead member relative to the load ring; and wherein step (b) further comprises:

shearing the lock member to allow the inner wellhead member to move further downward relative to the load ring; and expanding the load ring radially outward as the inner wellhead member moves downward.

20. The method of claim 15, wherein in step (c), the load ring engages the downward facing load shoulder and the centralizer/overpull assembly outwardly engages the recess substantially simultaneously.

* * * * *